United States Patent [19]

Sinopoli

[11] Patent Number: 4,947,636

[45] Date of Patent: Aug. 14, 1990

[54] METAL WIRE CORD FOR ELASTOMER REINFORCEMENT

[75] Inventor: Italo M. Sinopoli, Canton, Ohio

[73] Assignee: The Goodyear Tire & Rubber Company, Akron, Ohio

[21] Appl. No.: 309,166

[22] Filed: Feb. 13, 1989

[51] Int. Cl.[5] ..... D02G 3/48

[52] U.S. Cl. ..... 57/218; 57/212; 57/213; 57/902

[58] Field of Search ..... 57/212, 213, 214, 218, 57/230, 231, 902; 152/527, 555, 556

[56] References Cited

U.S. PATENT DOCUMENTS

| | | | |
|---|---|---|---|
| 157,931 | 12/1874 | Roebling | 57/218 |
| 3,555,789 | 2/1969 | Terragna | 57/218 |
| 3,762,145 | 10/1973 | Kikuchi et al. | 57/218 |
| 4,176,513 | 12/1979 | Young et al. | 57/218 X |

*Primary Examiner*—Stuart S. Levy
*Assistant Examiner*—Steven M. duBois
*Attorney, Agent, or Firm*—T. P. Lewandowski

[57] ABSTRACT

A metal cord for reinforcing elastomeric articles, such as earth mover tires, comprises a plurality of metal wire-filament strands, including a center strand and multiple peripheral strands concentrically surrounding the center strand. Each of the center and peripheral strands includes multiple individual wire filaments of similar diameter having identical strand lay direction and length. Each strand has a hexagonally close-packed longitudinally uniform polygonal outline in which filaments are in concentric layers, with each individual filament being tangential to all adjacently surrounding filaments. The peripheral strands are tangential to the center strand and have a predetermined cord lay length and direction either the same as (Lang's Lay) or opposite to that of the center strand.

30 Claims, 4 Drawing Sheets

METAL WIRE CORD FOR ELASTOMER REINFORCEMENT

Figure 1:
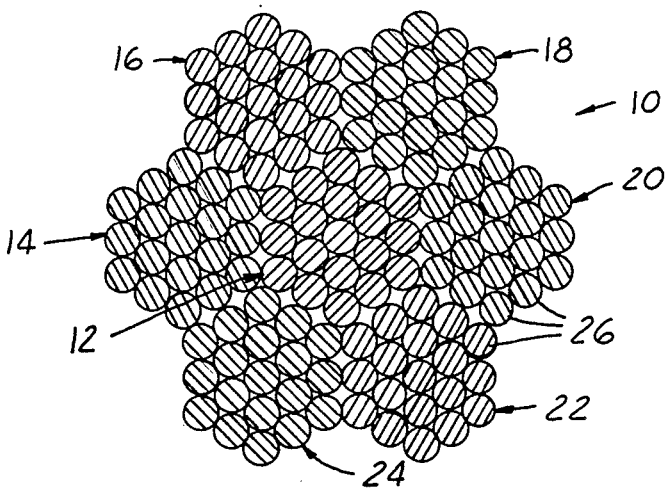

The present invention is directed to metal wire cords for reinforcement of elastomeric articles such as tires.

As conventionally employed in the art and in this application, the term "strand" refers to a group of individual "wires" or "filaments" combined to form a unit product. "Stranding" is the laying of several wires helically around a center wire. The axial distance required for a wire to make a 360° revolution around the center wire is the "length of lay" or "lay length" of the strand. The direction of lay may be either right-hand ("Z") or left-hand ("S"). The term "cord" refers to an end product for reinforcement purposed, and may be composed of a single strand, or of multiple strands "layed" or "cabled" together in either the S or Z direction. A cord having "ordinary lay" is one in which the wires of the individual strands are laid in one direction, and the strands of the cord are laid in the opposite direction. A cord having "Lang's lay" is one in which both the wires in the strands and the strands in the cord are laid in the same direction. The term "cord" employed in the elastomer-reinforcement art is generally considered to be synonymous with the terms "cable" and "rope" employed for similar structures in other arts.

It is conventional practice to manufacture multiple-strand wire cords, for tire reinforcement and like applications, by cabling layered strands at a specified lay length. For example, a 1+6+12x.20 strand for reinforcing earth mover tires is conventionally manufactured by first laying six filaments (e.g., six plated steel wires each of 0.20 mm diameter) helically around a center or core filament, and then laying 12 filaments in a second operation around the six intermediate filaments. The six intermediate filaments and the twelve outer filaments have the same lay direction but differing lay lengths. Multiple strands of nineteen filaments are then cabled to form a cord, with the strands of successive layers having opposite lay direction. A single filament is then spirally wrapped around the cord, so that the cord is ready for use as a tire reinforcement.

To eliminate manufacturing steps and associated cost, it has heretofore been purposed to form so-called "bunched" or "compact" wire strands in a single operation in which filaments having similar diameter are simultaneously layed together in the same direction and having the same lay length. The resulting strand possesses a hexagonally close-packed polygonal cross section that is generally uniform over the length of the strand. The filaments in the strand cross section are arranged in concentric layers in which each individual filament is tangential to all adjacent surrounding filaments.

A general object of the present invention is to provide a multi-strand wire cord that is more economical to manufacture than are cords of similar character heretofore proposed in the art for reinforcing tires and other elastomeric articles, while maintaining or improving strength and wear characteristics of the cord.

In accordance with the present invention, a wire cord for reinforcing elastomeric articles, such as earth mover tires, comprises a plurality of wire strands, including a center strand and multiple peripheral strands concentrically surrounding the center strand. Each of the center and peripheral strands includes multiple individual wire filaments of similar diameter having identical strand lay direction and hexagonally close-packed length. Each strand possess a polygonal cross sectional outline that is generally uniform lengthwise of the strand. Each strand has filaments in concentric layers, with each individual filament being tangential to all immediately adjacent surrounding filaments within each strand, all of which is to say that the strands are of bunched configuration. The peripheral strands are tangential to the center strand, and have a predetermined cord lay direction and length with respect to the center strand.

In the preferred embodiments of the invention, all of the strands have the same number of filaments, and the filaments have diameters in the range of about 0.175 to 0.30 mm. Strand lay length preferably is in the range of about 10 to 18 mm, and cord lay length preferably is greater than strand lay length and in the range of about 18 to 30 mm. In one embodiment of the invention, the filaments of the center strand are of greater diameter than the filaments of the peripheral strands, while in other embodiments of the invention all filaments are of identical size. The cord lay direction is in the Lang's lay direction in which cord and strand lay directions are the same, or in the so-called regular lay direction in which the cord lay direction is opposite to the strand lay direction. Cords in accordance with the invention having Lang's lay direction exhibit enhanced properties and characteristics as compared with both cords in accordance with the invention having the opposite (regular) lay twist direction and cords in accordance with the prior art.

The invention, together with additional objects, features, and advantages thereof, will be best understood from the following description, the appended claims and the accompanying drawings in which:

FIG. 1 is a schematic cross sectional diagram of a metal wire cord in accordance with a presently preferred embodiment of the invention; and FIGS. 2–8 are schematic cross sectional diagrams of respective modified embodiments of the invention.

Figure 2:
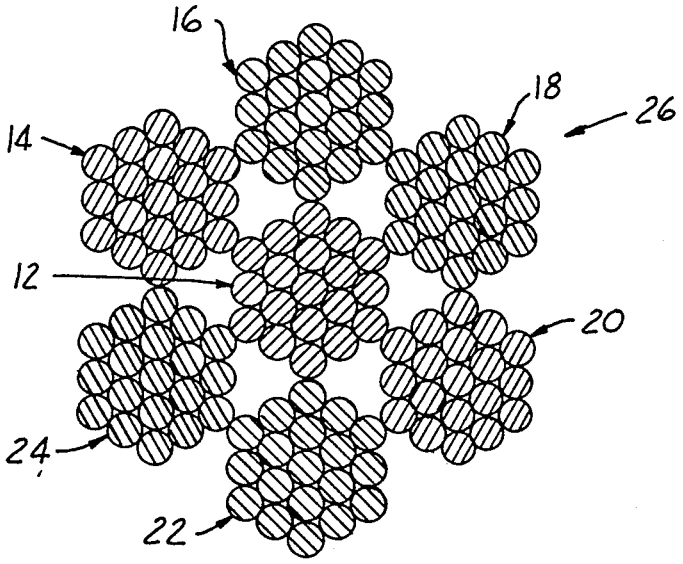

FIG. 1 illustrates a wire cord 10 in accordance with a presently preferred embodiment of the invention as comprising a center strand 12 concentrically and contiguously surrounded by six outer or peripheral strands 14–24. The several strands 12–24 are of identical construction, each including multiple individual wire filaments 26 of identical diameter and having identical strand lay direction and length. Each strand possesses a hexagonally close-packed polygonal outline that remains substantially uniform throughout the strand length. The several filaments 26 within each strand are disposed in concentric layers around a center filament, with each individual filament being tangential to all adjacently surrounding filaments. Most preferably, the individual strands 12–24 are of so-called bunched construction of the character described in the U.S. Pat. No. 4,608,817, the disclosure of which is incorporated herein by reference for purposes of background. The peripheral strands 14–24 are tangential to center strand 12 and, in the embodiment of FIG. 1, have the same lay direction as do the individual strands, which is to say that cord 10 is formed by laying individual strand 12–24 in the Lang's lay direction. FIG. 2 illustrates a cord 26 that is identical to cord 10 (FIG. 1) in all respects with the exception of the cord lay direction. Specifically, the individual strands 12–24 in cord 26 are layed in a direction opposite to the lay direction of the individual strands—i.e., in the regular lay direction.

A number of 7×19×.20 test cables A–F where prepared in accordance with the embodiment of the invention illustrated in FIGS. 1 and 2 at differing strand and lay lengths. The test cables were constructed of high tensile steel having a carbon content by weight in the range of 0.7 to 0.9%, preferably 0.82%, and an average tensile strength for 0.20 mm wire of 3400 MPa. These cables where subjected to various strength and wear tests, and the results are illustrated in the following Table I, together with test results on a "control" cable (G) manufactured in accordance with the multiple-step prior art technique discussed above:

TABLE I

| Part | FIG. No. | Strand Lay Length (mm) | Strand Lay Direction | Stand Break Strength (Newtons) | Cable Lay Length (mm) |
|---|---|---|---|---|---|
| A | 2 | 16 | Z | 1930 | 22 |
| B | 1 | 16 | Z | 1930 | 22 |
| C | 1 | 16 | Z | 1930 | 30 |
| D | 2 | 14 | Z | 1933 | 22 |
| E | 1 | 14 | Z | 1933 | 22 |
| F | 2 | 14 | Z | 1933 | 17 |
| G | — | 10 | S | 1900* | 22 |

| Part | Cable Lay Direct | Cable Break Strength (Newtons) | Cable Eff ** | Fatigue 3-Roll Cable |
|---|---|---|---|---|
| A | S | 8717 | 0.61 | 34933 |
| B | Z | 11233 | 0.79 | 30302 |
| C | Z | 11458 | 0.81 | 30051 |
| D | S | 9108 | 0.64 | 36340 |
| E | Z | 11625 | 0.82 | 43941 |
| F | S | 7383 | 0.52 | 28595 |
| G | Z | 9292 | 0.66* | 43583 |

| Part | Unwrapped Diameter (mm) | Linear Density (g/m) | Tabor Stiffness | Elasticity (%) |
|---|---|---|---|---|
| A | 3.036 | 35.447 | 778 | 55 |
| B | 2.955 | 35.191 | 562 | 78 |
| C | 2.988 | 34.800 | 608 | 78 |
| D | 3.052 | 35.330 | 708 | 54 |
| E | 2.955 | 35.183 | 606 | 72 |
| F | 3.007 | 36.255 | 490 | 44 |
| G | 3.001 | 35.053 | 396 | 72 |

*Estimated values

**Cable efficiency is a measure of filament strength to cable strength loss. Calculation: (Cable Break Strength/(7* strand break strength)) *0.95 (strand break strength efficiency)

It will be noted that the Lang's lay cables B, C and E, having cross sectional contours as illustrated in FIG. 1, on average exhibit a twenty percent increase in break strength as compared with the prior art control cable G, and also as compared with the opposite-lay direction cables A, D and F of the invention having the contour FIG. 2. Such improved properties are retained. This is due to uniform breaking of substantially all strands (i.e., six or seven strands in the configuration of FIG. 1 versus four or five strands in the configuration of FIG. 2) during the tensile test. Cable E is representative of the most preferred embodiment of the invention, having a strand lay length of 14 mm and a cord lay length of 22 mm.

FIGS. 3–8 illustrate modified embodiments of the invention, of which constructions may be summarized in the following table:

TABLE II

Figure 3:
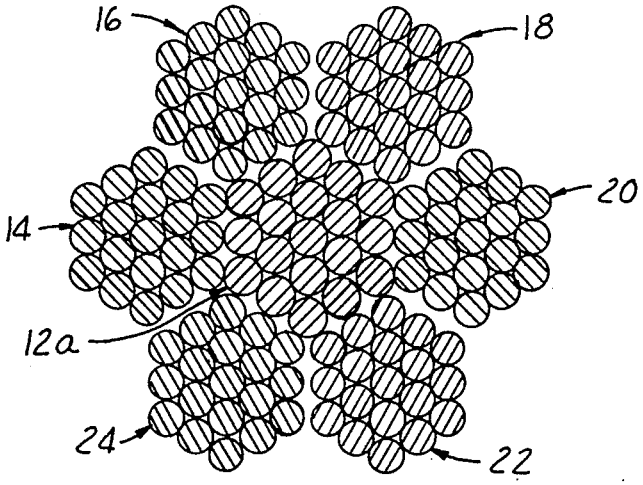
Figure 4:
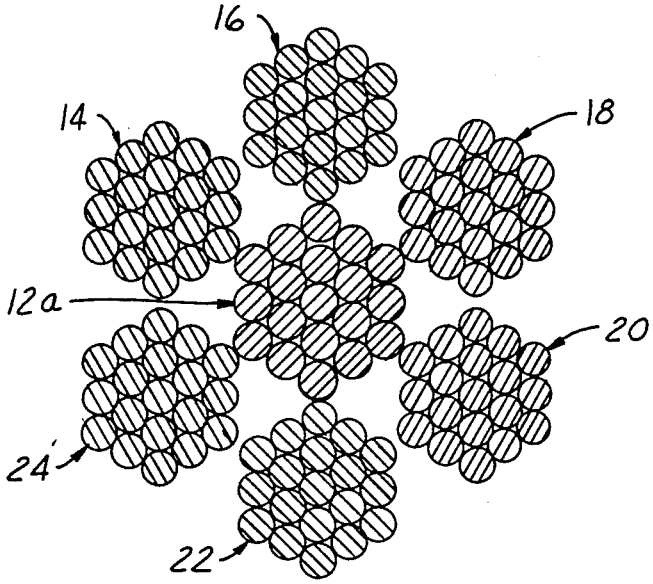
Figure 5:
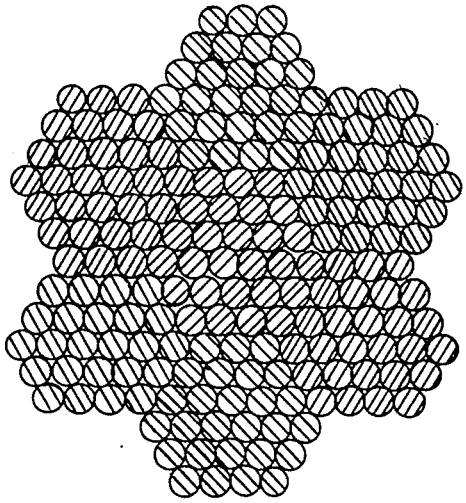
Figure 6:
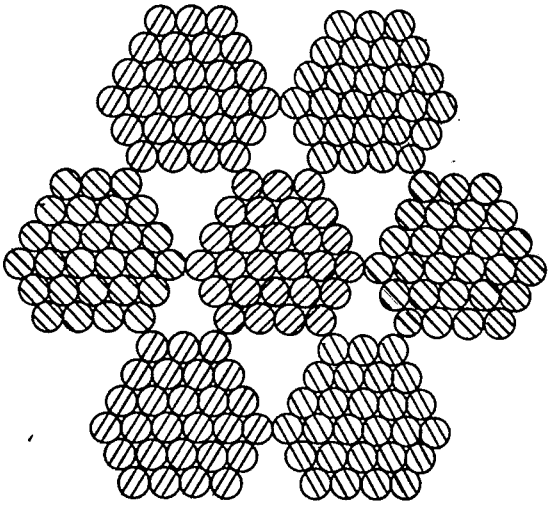

| | | |
|---|---|---|
| FIG. 3 | 1 × 19 × .22 + 6 × 19 × .20 | Lang's Lay |
| FIG. 4 | 1 × 19 × .22 + 6 × 19 × .20 | Opposite Lay |
| FIG. 5 | 7 × 27 × | Lang's Lay |
| FIG. 6 | 7 × 27 × | Opposite Lay |

TABLE II-continued

Figure 7:
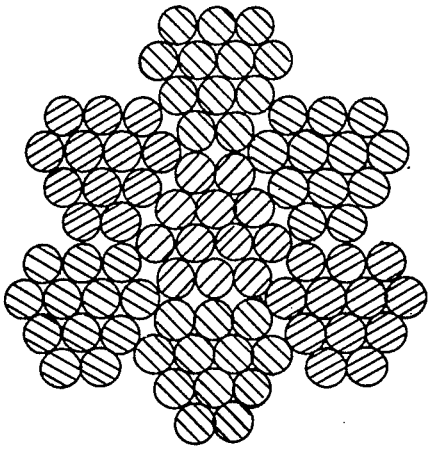
Figure 8:
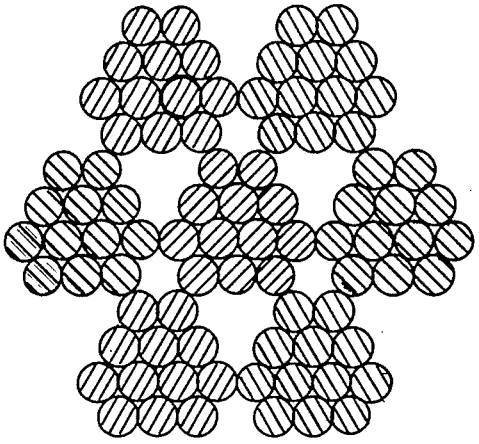

| | | |
|---|---|---|
| FIG. 7 | 7 × 12 × | Lang's Lay |
| FIG. 8 | 7 × 12 × | Opposite Lay |

It is to be noted that, in the embodiments of FIGS. 3 and 4, the center strand **12*a* is constructed of filaments having a diameter that is greater than diameter of the filaments in the outer strands 14–24**. This construction has the advantage of providing openings between the strands in the final cross section for enhanced rubber penetration and improved wear characteristics.

I claim:

1. A metal cord for reinforcing elastomers and the like comprising:

a plurality of wire strands, including a center strand and multiple peripheral strands concentrically surrounding said center strand, each of said center and peripheral strands including multiple individual filaments of similar constant diameter having identical strand lay direction and length, a hexagonally close-packed longitudinally uniform polygonal cross sectional outline, and having filaments in concentric layers in which each individual filament is tangential to all adjacent surrounding filaments, said peripheral strands being tangential to said center strand and having a predetermined cord lay direction the same as said strand lay direction and a predetermined lay length with respect to said center strand, said cord being of substantially uniform cross sectional dimension throughout its length.

2. The cord set forth in claim 1 comprising six of said peripheral strands concentrically surrounding said center strand.

3. The cord set forth in claim 2 wherein diameter of said filaments is in the range of about 0.175 to 0.30 mm.

4. A metal cord for reinforcing elastomers and the like that comprises:

seven wire strands, including a center strand and six peripheral strands concentrically surrounding said center strand, each of said strands including multiple filaments of 0.20 mm diameter having identical strand lay direction and length of about 14 mm, a hexagonally close-packed longitudinally uniform polygonal cross sectional outline, and having filaments in concentric layers in which each individual filament is tangential to all adjacent surrounding filaments, all of said strands having the same number of filaments and being identical, said peripheral strands being tangential to said center strand and having a lay direction the same as said strand twist direction, and a lay length of about 22 mm.

5. The cord set forth in claim 4 wherein said filaments are of high tensile steel construction having a carbon content of substantially 0.82% by weight.

6. A metal cord for reinforcing elastomers and the like comprising:

a plurality of wire strands, including a center strand and six peripheral strands concentrically surrounding said center strand, each of said center and peripheral strands including multiple individual filaments of similar constant diameter in the range of 0.175 to 0.30 mm having identical strand lay direction and length, a hexagonally close-packed longitudinally uniform polygonal cross sectional outline, and having filaments in concentric layers in which each individual filament is tangential to all adjacent surrounding filaments, said peripheral strands being tangential to said center strand and having a predetermined cord lay direction and length with respect to said center strand.

7. The cord set forth in claim 6 wherein said cord lay is in the same direction as said strand lay.

8. The cord set forth in claim 6 wherein said cord lay and said strand lay are in opposite directions.

9. The cord set forth in claim 6 wherein all of said filaments in all of said strands are of identical diameter.

10. The cord set forth in claim 9 wherein all of said filaments have a diameter of substantially 0.20 mm.

11. The cord set forth in claim 6 wherein filaments in said center strand are of greater diameter than filaments in said peripheral strands.

12. The cord set forth in claim 11 wherein filaments in said center strand have a diameter of about 0.22 mm, and filaments in said peripheral strands have diameters of about 0.20 mm.

13. The cord set forth in claim 6 wherein said cord lay length is greater than said strand lay length.

14. The cord set forth in claim 13 wherein said cord lay length is in the range of 18 to 30 mm.

15. The cord set forth in claim 14 wherein said strand lay length is in the range of about 10 to 18 mm.

16. The cord set forth in claim 6 in which of all said strands include the same number of filaments.

17. The cord set forth in claim 17 wherein said number is in the range of 12 to 27.

18. The cord set forth in claim 17 wherein said number is selected from the group consisting of 12, 19, and 27.

19. A metal cord for reinforcing elastomers and the like comprising:

a plurality of wire strands, including a center strand and six peripheral strands concentrically surrounding said center strand, each of said center and peripheral strands including multiple individual filaments of similar constant diameter having identical strand lay direction and length, a hexagonally close-packed longitudinally uniform polygonal cross sectional outline, and having filaments in concentric layers in which each individual filament is tangential to all adjacent surrounding filaments, said peripheral strands being tangential to said center strand and having a predetermined cord lay direction with respect to said center strand, and a cord lay length that is greater than said strand lay length.

20. The cord set forth in claim 19 wherein diameter of said filaments is in the range of about 0.175 to 0.30 mm.

21. The cord set forth in claim 19 wherein said cord lay length is in the range of about 18 to 30 mm, and said strand lay length is in the range of about 10 to 18 mm.

22. The cord set forth in claim 21 wherein said cord lay length is substantially equal to 22 mm and said strand lay length is substantially equal to 14 mm.

23. A metal cord for reinforcing elastomers and the like comprising:

a plurality of wire strands, including a center strand and six peripheral strands concentrically surrounding said center strand, each of said center and peripheral strands including multiple individual filaments of similar diameter having identical strand lay direction and length, a hexagonally close-packed longitudinally uniform polygonal cross sectional outline, and having filaments in concentric layers in which each individual filament is tangential to all adjacent surrounding filaments, said peripheral strands being tangential to said center strand and having a predetermined cord lay direction and length with respect to said center strand, said cord lay length being in the range of about 18 to 30 mm.

24. The cord set forth in claim 23 wherein said strand lay length is in the range of about 10 to 18 mm.

25. The cord set forth in claim 24 wherein said cord lay length is substantially equal to 22 mm and said strand lay length is substantially equal to 14 mm.

26. The cord set forth in claim 23 wherein said cord lay length is substantially equal to 22 mm.

27. A metal cord for reinforcing elastomers and the like comprising:

a plurality of wire strands, including a center strand and six peripheral strands concentrically surrounding said center strand, each of said center and peripheral strands including multiple individual filaments of similar diameter having identical strand lay direction and length, a hexagonally close-packed longitudinally uniform polygonal cross sectional outline, and having filaments in concentric layers in which each individual filament is tangential to all adjacent surrounding filaments, said peripheral strands being tangential to said center strand and having a predetermined cord lay direction and length with respect to said center strand, said strand lay length being in the range of about 10 to 18 mm.

28. The cord set forth in claim 27 wherein said cord lay length is in the range of 18 to 30 mm.

29. The cord set forth in claim 28 wherein said cord lay length is substantially equal to 22 mm and said strand lay length is substantially equal to 14 mm.

30. The cord set forth in claim 27 wherein said strand lay length is substantially equal to 14 mm.

* * * * *